US005704481A

United States Patent [19]

Lutz

[11] Patent Number: 5,704,481

[45] Date of Patent: Jan. 6, 1998

[54] EASY OPEN PACKAGE

[75] Inventor: David Lutz, Orland Park, Ill.

[73] Assignee: Ivex Corporation, Lincolnshire, Ill.

[21] Appl. No.: 341,768

[22] Filed: Nov. 18, 1994

[51] Int. Cl.[6] ..... B65D 75/26; B65D 75/62

[52] U.S. Cl. ..... 206/484; 206/469; 383/205

[58] Field of Search ..... 206/484, 469, 206/484.1; 383/201, 205, 206, 207; 229/237, 238, 239

[56] References Cited

U.S. PATENT DOCUMENTS

| | | | |
|---|---|---|---|
| 3,270,878 | 9/1966 | Giesler | 206/484 |
| 4,030,662 | 6/1977 | Gess | 206/484 X |
| 4,476,976 | 10/1984 | Smith | 206/219 |
| 4,506,789 | 3/1985 | Dlugosz | 206/532 |
| 4,638,911 | 1/1987 | Prohaska | 206/484 X |
| 4,781,294 | 11/1988 | Croce | 206/469 |
| 5,135,790 | 8/1992 | Kaplan et al. | 229/238 |
| 5,180,599 | 1/1993 | Feldmeier et al. | 206/469 X |

*Primary Examiner*—Jimmy G. Foster
*Attorney, Agent, or Firm*—Lockwood, Alex, Fitzgibbon & Cummings

[57] ABSTRACT

An easy access tear-open paperboard package and method of making same are provided including a pair of corrugated paperboard sheets, each having an interior surface flood coated with a cohesive material which sheets are then joined together in surrounding relation to an article such as a book contained therebetween. A strip of polyolefin tape extends across the interior surface of at least one of the corrugated paperboard sheets to provide a non-bonding area. A pair of spaced parallel perforations extend through paperboard sheet and the tape to form a tear strip which is narrower in width than the tape to provide access to the interior compartment.

17 Claims, 3 Drawing Sheets

EASY OPEN PACKAGE

The present invention relates in general to shipping wrappers or packages and blanks for forming the same and, more particularly, to tear-open, paperboard packages which are formed from a novel corrugated paperboard blank. In this regard, an important aspect of this invention concerns a single-use corrugated paperboard package having a tear strip formed therein, which package is especially suited for sending articles such as books and the like through the mail or by private carrier or shipper.

BACKGROUND AND SUMMARY OF THE INVENTION

Heretofore, packages for sending books and like articles have included end flaps and side flaps which are folded, inserted in preformed slots, glued and sealed. These prior art packages while generally reliable have required specially designed machinery to make the intricate folds and provide precise placement of glue or other adhesive. In addition, the large volume of articles sent by this type of packaging often mandates that the packaging be done quickly in automated systems. The numerous manipulative steps required to be performed by these specially designed automated systems, however, requires that they be relatively complex and expensive. A need exists therefore, for a package and method of packaging articles with a simple packaging blank of paperboard which can be quickly and inexpensively manufactured in various sizes and which further can be quickly formed into an easy open article-containing package. The present invention overcomes the drawbacks and disadvantages of these prior art packages.

In accordance with one aspect of the present invention, an improved easy access tear-open paperboard package is provided with first and second substantially identical paperboard sheets, preferably single-faced corrugated paperboard sheets, each having an interior corrugated and exterior liner surface. The interior surface of each of the sheets is flood coated with a cohesive material and the two sheets are positioned in a interior face to interior face relationship so that the two sheets will be sealed together upon contact, generally around their respective peripheral edges forming an interior compartment which generally conforms to the shape of the article positioned therein. An elongated covering strip, preferably a polyolefin strip, is bonded to the interior surface of at least one of the sheets and preferably extends from a first edge to an opposite edge across the sheet. A tear strip having a width narrower than that of the polyolefin strip overlies the polyolefin strip and is defined by a pair of parallel spaced apart perforations that extend through the sheet and the polyolefin strip. Grasping one end of the tear open strip enables the tear strip and the polyolefin strip portion associated therewith to be severed from the package to provide quick and easy access to the article contained in the interior compartment.

It is therefore a general object of the present invention to provide an improved easy access tear-open paperboard package.

Another object of the present invention is to provide an improved and easily manufactured tear-open paperboard package particularly suited for shipment of articles as books by mail or private carrier.

Another object of the present invention is to provide a blank that is easily formed into an improved tear-open paperboard package.

These and other objects of the present invention will be apparent from the following detailed description taken in conjunction with the accompanying drawings wherein the like reference numerals refer to like parts.

DETAILED DESCRIPTION OF THE INVENTION

Figure 1:
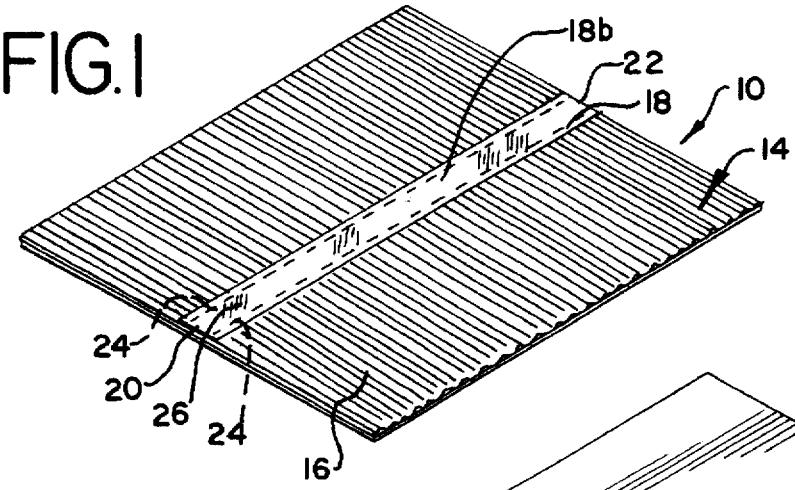
FIG. 1 is a perspective view of a paperboard blank useful for forming the package made according to the present invention.

Referring to the drawings and, with particular reference to FIGS. 1–4, a paperboard package 28 embodying the present invention is formed from a blank 10, preferably composed of single face corrugated paperboard. As shown, blank 10 has a generally rectangular configuration with an exterior surface 12 and interior surface 14. Exterior surface 12 is commonly referred to as the liner side and interior surface 14 is commonly referred to as the corrugated or median side.

Blank 10 utilized to form the package of the present invention includes a coating of a cohesive material 16. The coating 16 is applied to substantially the entire interior surface 14 of the paperboard, typically by known flood coating techniques. It should be understood that cohesive material 16 may be of any type well known in the art utilized to create a cohesively coated paperboard that will readily stick and bond to like cohesively coated paperboard but which does not stick or bond to surfaces which are not coated with the cohesive coating material.

Blank 10 is also provided with a length of polyolefin tape 18, preferably polyethylene tape, that extends from one edge 20 of blank 10 to an opposite edge 22 across interior corrugated surface 14. Typically, the polyethylene tape will be less than three millimeters in thickness. Tape 18 may extend parallel with or transversely to the ridges disposed on the interior face of the corrugated paper although transversely to the ridges is preferred due to manufacturing efficiency.

In order to secure the tape to the paperboard, one side **18*a* of the tape is coated with either an adhesive material of a type well known in the art or the same cohesive material the interior surface of the blank is flood coated. The opposite or exposed side 18*b*** of the tape is free of any adhesive or cohesive coating.

A pair of spaced apart parallel perforation lines 24 extend coextensively with the polyethylene tape 18 from edge 20 to edge 22 extending through the paperboard blank 10 and the tape 18. Perforations 24 define a tear strip 26 for gaining access to the interior compartment of the package when the blank is formed into a package. Tear strip 26 defined between perforations 24 should be slightly narrower in width than tape 18 to ensure complete and easy opening of the package as will be explained below.

Figure 2:
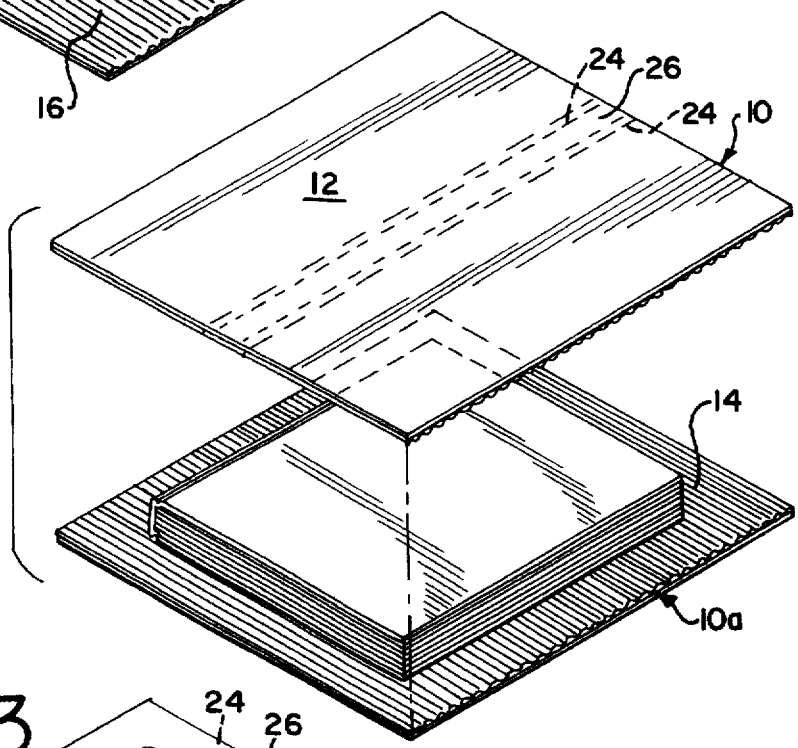
FIG. 2 is an exploded perspective view of a paperboard package of FIG. 1 made according to the present invention.
Figure 3:
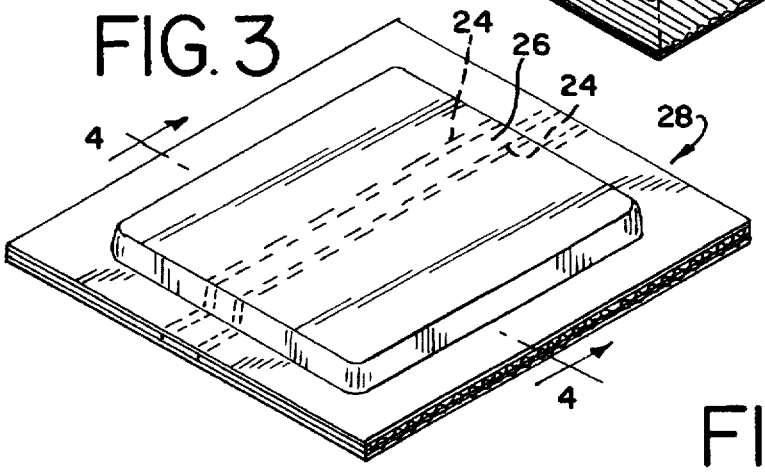
FIG. 3 is a perspective view of a paperboard package made according to the present invention.
Figure 4:
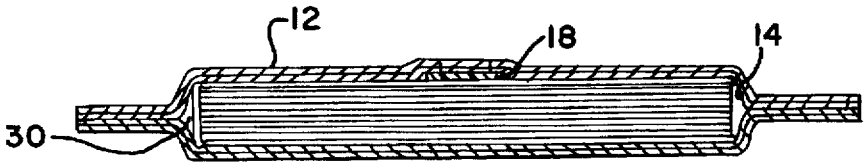
FIG. 4 is a cross-sectional view of a paperboard package of FIG. 3 made according to the present invention and taken along line 4—4.
Figure 5:
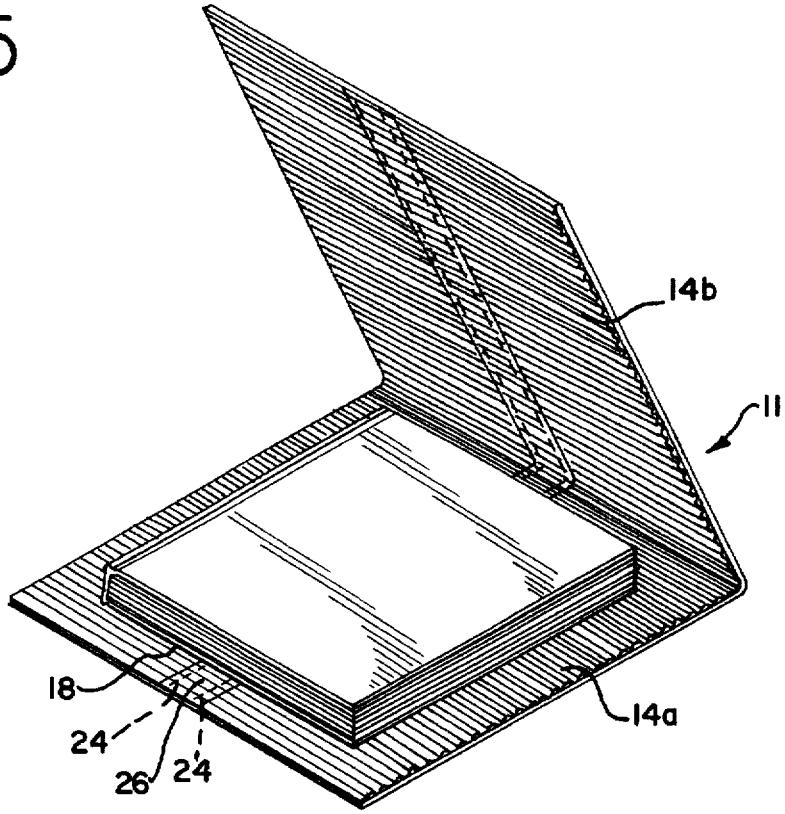
FIG. 5 is a perspective view of an alternate embodiment of the paperboard package prior to being sealed made according to the present invention.

Blank 10 described above is utilized to form package 28 of the present invention illustrated in FIGS. 2 and 4. Package 28 of FIG. 2 is made utilizing blank 10 having its interior surface 14 in face to face spaced relationship with the interior surface of a blank 10*a* which is substantially identical to blank 10 except that blank 10*a* does not require a tear strip or polyolefin strip. Like portions of the interior surface of each of the blanks 10 and 10*a* are joined together, generally around their respective periphery by cooperation of the cohesive coating 16 applied to their respective interior surfaces. The remaining like portions of each of the blanks 10 and 10*a* are spaced apart to form an interior compartment 30. As shown, interior compartment 30 conforms to the contour of the article contained within the package. For example, the package 28 is illustrated in exploded form (FIG. 2) showing a book disposed between opposing interior surfaces of blanks 10 and 10*a*. Thus, the interior compartment of package 28 is shaped and sized in dimensions similar to those of the book. It should be noted that the sealing of the like portions of each of the blanks 10 and 10*a* may be done by hand or when speed is of essence, by a stamping or sealing machine of a type well known in the art. In addition, because a cohesive coating is utilized, the interior surfaces of blanks 10 and 10*a* will not bond to the book or other article contained therein.

Access to interior compartment 30 of package 28 is provided by tear strip 26. In the illustrated embodiments, tear strip 26 runs from one edge of the package to an opposite edge of the package and extends through blank 10 and polyethylene tape 18. The exposed surface 18*b* of the polyethylene tape prevents bonding between the adjacent interior surfaces 14 of blanks 10 and 10*a* since the cohesively coated interior surfaces will only bond to other cohesively coated surfaces. Because tear strip 26 likewise extends coextensively with tape 18 and is narrower in width than tape 18 it is not bonded to the interior surface of the other blank 10*a* and may be easily separated from blank 10*a*, enabling it to be severed along perforation lines 24 to provide quick and easy access to the interior compartment. Also, since tape 18 is wider than tear strip 26, it performs a second function of maintaining the integrity of the tear strip during its severance from blank 10.

If desired, the package of FIG. 2 may be formed with identical blanks 10, each being flood coated on their interior surface with a cohesive material, each having a polyolefin tape extending from edge to edge, and each having a pair of spaced perforations extending across the blank forming a tear strip which extends coextensively with the tape. Thus, the package would have two tear strips on either side of the package.

Figure 6:
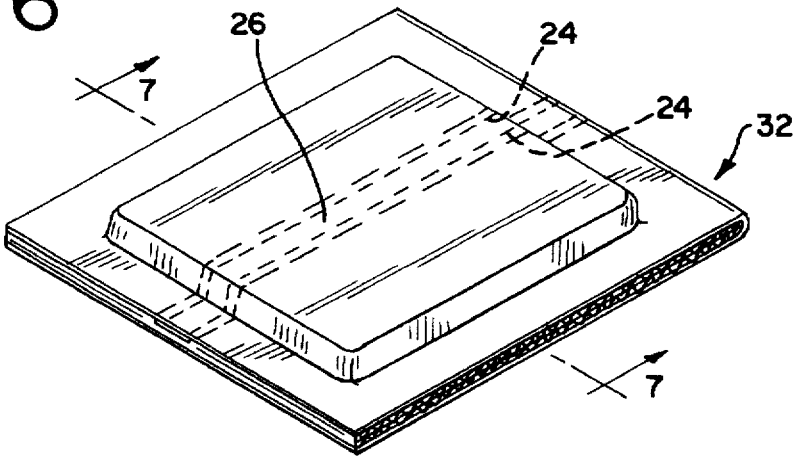
FIG. 6 is a perspective view of an alternate embodiment of a paperboard package made according to the present invention.
Figure 7:
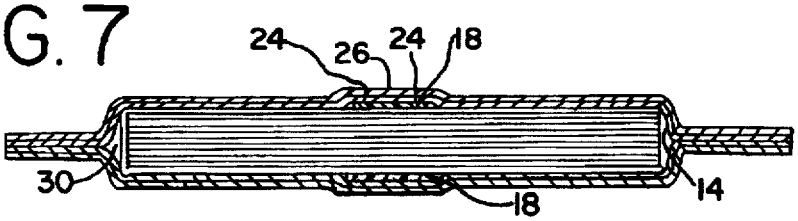
FIG. 7 is a side sectional view of the package of FIG. 6 taken along line 7—7.

An alternate embodiment of a package made according to the present invention is illustrated in FIGS. 6 and 7 and is formed from a single blank 11. Blank 11 is substantially identical to blank 10 and includes the cohesive coating 16 on the interior surface 14, polyethylene tape 18, and perforations 24 as described above. As shown, however, blank 11 is generally twice as long as blank 10 for packaging identically sized articles, enabling it to form both the top and bottom packaging sheets. Package 32 is formed by folding the interior surface of blank 11 onto itself forming opposing interior surface sections 14*a* and 14*b* of a substantially identical size. An article to be packaged is placed between the opposing interior surface sections and like portions of each of the opposing interior surface sections 14*a* and 14*b* are sealed together by cooperation of the cohesive coating. The remaining like portions of interior surface portions 14*a* and 14*b* are spaced apart forming interior compartment 30. Interior compartment 30 as before, generally conforms to the contour of the article packaged therein.

In package 32, the tear strip 26 formed between the spaced parallel perforations extends around the entire package. The polyolefin tape again prevents bonding between the opposing interior surface sections along the tape's outer surface allowing tear strip 26 to be easily severed from blank 11.

Figure 8:
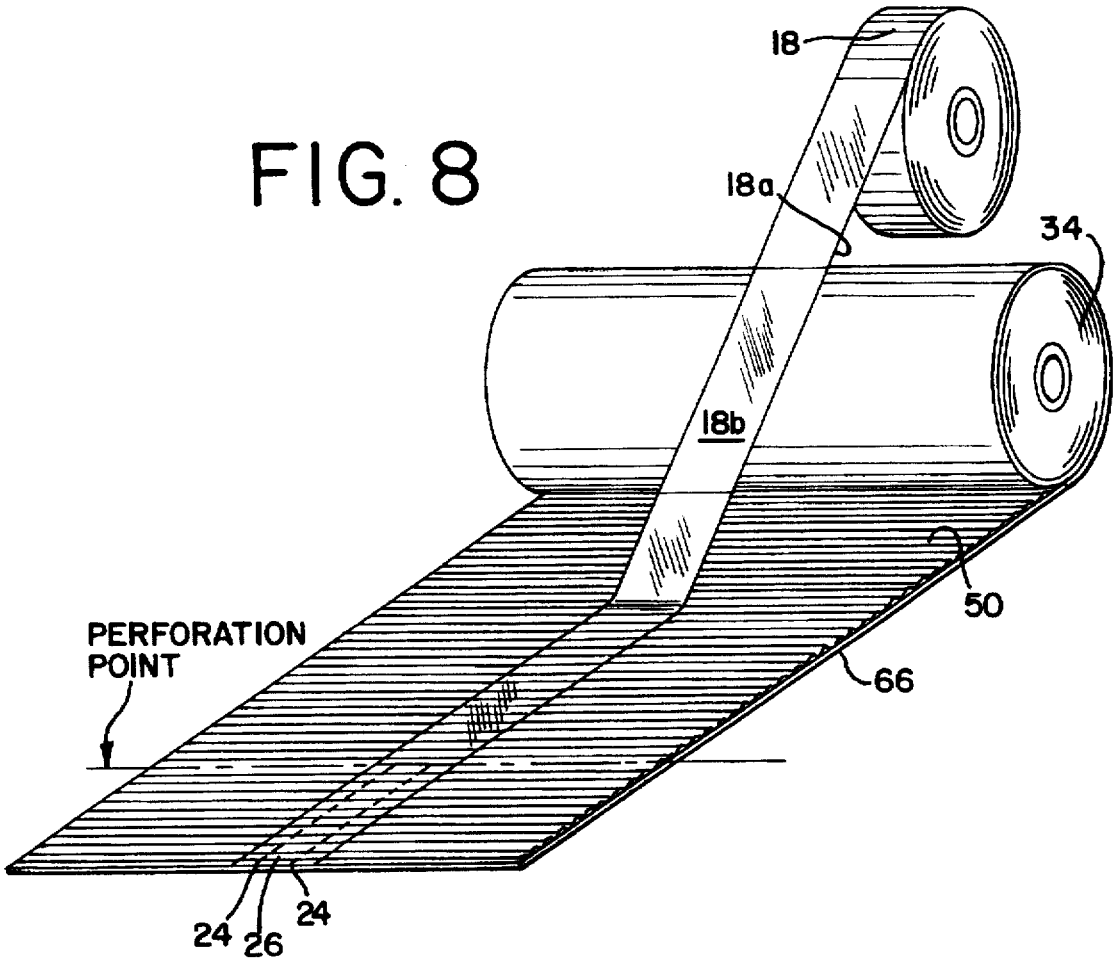
FIG. 8 is a perspective view illustrating a method of forming the blank useful in making the paperboard package of the present invention.

Blanks 10 and 11 utilized to form the packages of FIGS. 2–6 according to the present invention are easily manufactured. As illustrated in FIG. 8, a web 34 of single faced corrugated paperboard 66 of a type well known in the art having a free end is advanced with the undulated surface or corrugated face 50 disposed upwardly. In the illustrated embodiment, as the web is advanced, the entire corrugated face 50 is flood coated with a layer of cohesive material by a coating mechanism (not shown) of a type well known in the art. A web or roll of polyethylene tape 18 having one surface 18*a* coated with an adhesive material or a cohesive material is advanced simultaneously with the web of paperboard. The coated surface of the tape is in face to face relationship with the cohesively coated side of the paperboard as each is advanced at substantially the same linear speed. The tape 18 is applied at any desired location along the width of the web 34 (for example, the approximate center of the paperboard). If desired, a roller or other suitable pressure applying device (not shown) can be used to provide improved contact bonding of tape 18 to the corrugated face 50 of web 34.

Figure 9:
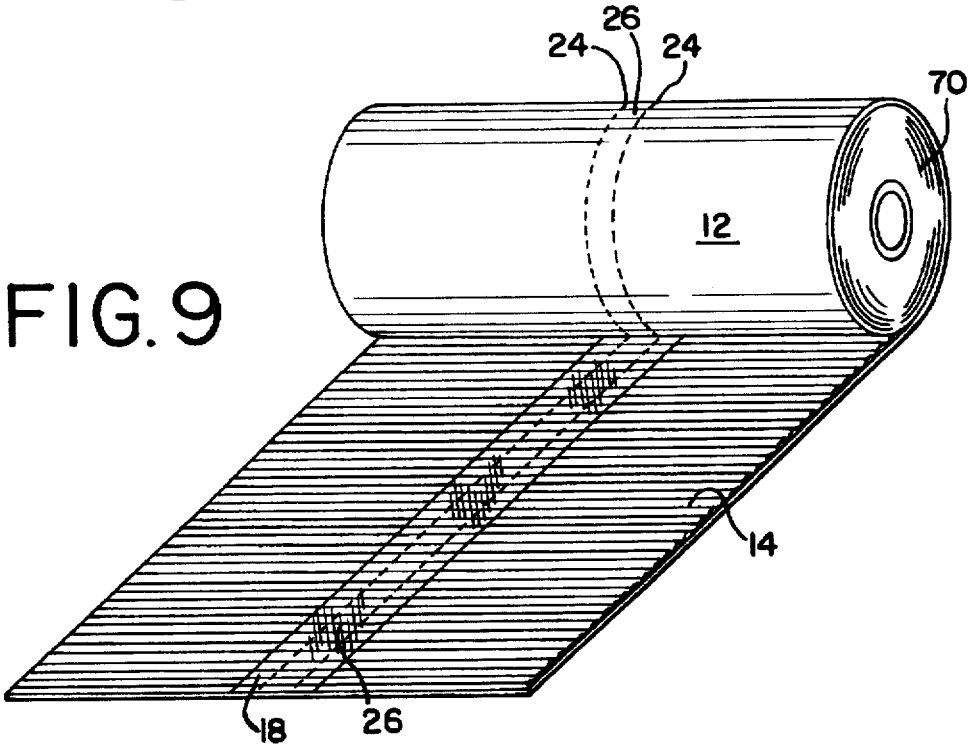
FIG. 9 is a perspective view of a web of paperboard formed in accordance with the present invention useful for making the paperboard package of the present invention.

Once tape 18 is attached, perforation tools (not shown) of a type generally known, form the spaced apart parallel perforations 24 which define the tear strip 26. The perforations extend through paperboard 66 and tape 18. A web 70 of paperboard formed in accordance with the present invention is illustrated in FIG. 9. Blanks of various lengths may be severed from web 70 and be utilized to form the packages of the present invention.

It will be seen that the present invention provides a new and useful easy access tear-open paperboard package and method of making same having a number of advantages and characteristics including those identified herein and others which are inherent in the invention. Preferred embodiments of the invention have been described by way of example, and it will be appreciated that modifications may be made to the described embodiments without departing from the spirit of the invention or the scope of the appended claims.

I claim:

1. A blank for forming an improved access, tear-open corrugated paperboard package comprising:

a sheet of paperboard having a first surface and a second surface; a cohesive coating over substantially the entire first surface of said sheet; a portion of said first surface having a covering strip having opposed longitudinal sides thereon, said covering strip having a bottom surface which is bonded to the cohesive coating on said first surface of said paperboard sheet, said covering strip having a top surface which does not adhere to said cohesive coating; and, at least one pair of spaced parallel perforations extending into said sheet and said covering strip between the longitudinal sides thereof to define a tear strip in said blank.

2. The blank of claim 1, wherein said sheet of paperboard is single face corrugated paperboard.

3. The blank of claim 1, wherein said first surface of said paperboard is corrugated and said second surface is smooth.

4. The blank of claim 1 wherein said covering strip comprises a polyolefin.

5. The blank of claim 4, wherein said covering strip is a polyethylene tape.

6. The blank of claim 1, wherein the bottom surface of said covering strip has a cohesive coating applied thereto.

7. The blank of claim 1, wherein the bottom surface of said covering strip has an adhesive coating applied thereto.

8. The blank of claim 1, wherein said covering strip extends from one edge of said sheet to another edge of said sheet.

9. An improved access, tear-open paperboard package for containing an article, said package comprising:

a first sheet of paperboard; a second sheet of paperboard; an article contained between said first and second paperboard sheets; said first and second sheets having interior surfaces which are in face-to-face relationship with each other, said interior surfaces of said first and second sheets each having a coating thereon which enables them to adhesively bond to each other which coating does not adhesively bond to said article contained within said package; said top and bottom sheets being adhered to each other in generally surrounding relationship to said article contained within said package; a covering strip over a portion of the interior surface of at least one of said first and second sheets, said covering strip having a bottom surface which is adhesively bonded to the interior surface of said at least one sheet, said covering strip having a top surface which does not adhesively bond to the coating on the interior surfaces of said first and second sheets; and, a tear strip formed in at least one of said first and second sheets and positioned in underlying relationship to said covering strip, said tear strip being narrower than said covering strip and being defined by perforations which extend into said at least one sheet and the covering strip, said tear strip being positioned so that when it is severed from said at least one sheet access to the interior of said package for removal of the article therefrom is provided.

10. The package of claim 9 wherein said first and second sheets are separately formed.

11. The package of claim 9 wherein said first and second paperboard sheets are formed from a single sheet which is folded so that one surface thereof forms said interior surfaces of said first and second sheets and the other surface thereof forms the exterior surface of said first and second sheets.

12. The package of claim 9, wherein said first and second paperboard sheets comprise single face corrugated paperboard.

13. The package of claim 9, wherein the interior surface of each of said first and second paperboard sheets is corrugated.

14. The package of claim 9, wherein said coating includes a layer of cohesive material disposed over substantially the entire interior surface of each of said first and second paperboard sheets.

15. The package of claim 9, wherein the bottom surface of said covering strip has a cohesive coating.

16. The package of claim 9, wherein said covering strip comprises polyolefin tape.

17. The package of claim 16, wherein said polyolefin tape extends from one edge of said one of said first and second sheets to another edge of said one sheet.

* * * * *